US009141042B2

(12) United States Patent
Yoshida et al.

(10) Patent No.: US 9,141,042 B2
(45) Date of Patent: Sep. 22, 2015

(54) IMAGE FORMING APPARATUS HAVING MISREGISTRATION CONTROL

(71) Applicant: CANON KABUSHIKI KAISHA, Tokyo (JP)

(72) Inventors: Tsuguhiro Yoshida, Yokohama (JP); Masahiro Suzuki, Numazu (JP); Akira Hayakawa, Kawasaki (JP); Tatsuya Kinukawa, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 17 days.

(21) Appl. No.: 13/860,797

(22) Filed: Apr. 11, 2013

(65) Prior Publication Data

US 2013/0272730 A1 Oct. 17, 2013

(30) Foreign Application Priority Data

Apr. 13, 2012 (JP) ..... 2012-091970

(51) Int. Cl.
*G03G 15/01* (2006.01)
*G03G 15/16* (2006.01)
*G03G 15/00* (2006.01)

(52) U.S. Cl.
CPC ..... *G03G 15/1675* (2013.01); *G03G 15/5058* (2013.01); *G03G 2215/0132* (2013.01); *G03G 2215/0161* (2013.01)

(58) Field of Classification Search
CPC ..... G03G 15/1675; G03G 15/5058; G03G 2215/0132; G03G 2215/0161
USPC ..... 399/39, 49, 72, 297, 301, 302
See application file for complete search history.

(56) References Cited

U.S. PATENT DOCUMENTS

| | | | | |
|---|---|---|---|---|
| 7,986,907 | B2 * | 7/2011 | Miyadera | 399/301 |
| 8,175,474 | B2 | 5/2012 | Kinukawa et al. | |
| 8,185,003 | B2 | 5/2012 | Hirai et al. | |
| 8,369,726 | B2 | 2/2013 | Kinukawa et al. | |
| 8,442,409 | B2 | 5/2013 | Hirai et al. | |
| 2006/0056864 | A1 * | 3/2006 | Zaima | 399/27 |
| 2008/0253781 | A1 * | 10/2008 | Takezawa | 399/39 |
| 2009/0296147 | A1 | 12/2009 | Kinukawa et al. | |
| 2010/0247125 | A1 * | 9/2010 | Akita | 399/49 |
| 2011/0097096 | A1 * | 4/2011 | Sueoka | 399/49 |
| 2011/0103814 | A1 * | 5/2011 | Toyama et al. | 399/49 |
| 2012/0275804 | A1 * | 11/2012 | Watanabe | 399/39 |
| 2013/0077984 | A1 * | 3/2013 | Yoshida | 399/66 |
| 2013/0148996 | A1 * | 6/2013 | Masui | 399/72 |

FOREIGN PATENT DOCUMENTS

| | | | |
|---|---|---|---|
| JP | 2009103832 A | * | 5/2009 |
| JP | 2012-42754 A | | 3/2012 |

* cited by examiner

*Primary Examiner* — Francis Gray
(74) *Attorney, Agent, or Firm* — Fitzpatrick, Cella, Harper & Scinto

(57) ABSTRACT

An image forming apparatus includes a plurality of image bearing members and a control unit. After an image forming mode starts until a toner image is primarily transferred onto an intermediate transfer member from an uppermost-stream image bearing member of the plurality of image bearing members provided at an uppermost stream position, the control unit is configured to provide a toner patch onto at least one of primary transfer portions. The toner patch is formed by developing an electrostatic latent image formed on at least one of the plurality of the image bearing members, and in the image forming mode a timing at which a trailing edge of the toner patch that passes through one of the plurality of the primary transfer portions reaches a secondary transfer portion is earlier than a timing at which the recording material reaches the secondary transfer portion.

13 Claims, 6 Drawing Sheets

IMAGE FORMING APPARATUS HAVING MISREGISTRATION CONTROL

BACKGROUND OF THE INVENTION

1. Field of the Invention

The present invention relates to an electrophotographic image forming apparatus such as a copying machine and a printer.

2. Description of the Related Art

Conventionally, a color image forming apparatus capable of outputting a full-color image in the following manner has been put into practical use. That is, toner images formed on surfaces of respective image bearing members are sequentially and temporarily transferred onto a surface of an intermediate transfer member for each color (hereinafter referred to as "primary transfer") so that a full-color superimposed image is formed on the surface of the intermediate transfer member. After that, the full-color toner image on the surface of the intermediate transfer member is transferred onto a recording material (hereinafter referred to as "secondary transfer").

In such an image forming apparatus, when there is a speed difference between the moving speed of the surface of the intermediate transfer member and the moving speed of the surface of the image bearing member, in a primary transfer step of superimposing the toner images of the plurality of colors from the image bearing members onto the intermediate transfer member, a phenomenon that images of the respective colors are misaligned may occur in some cases. In particular, a significant misregistration tends to occur between the toner image of a color that is primarily transferred onto the surface of the intermediate transfer member at the beginning and the toner image of a color that is primarily transferred onto the surface of the intermediate transfer member at the end. This phenomenon occurs because the amount of toner that exists at a contacting portion between the image bearing member and the intermediate transfer member (hereinafter referred to as "primary transfer portion") differs when the toner image of each color is transferred. In a primary transfer step of the first color, the primary transfer is performed on the surface of the intermediate transfer member under a state in which substantially no toner is provided on the surface, whereas in primary transfer steps of the second and subsequent colors, the primary transfer is performed on the surface of the intermediate transfer member under a state in which toner is already provided. Therefore, the frictional force acting between the image bearing member and the intermediate transfer member at the primary transfer portion differs depending on the presence and absence of toner at the primary transfer portion. Therefore, the moving speed of the surface of the intermediate transfer member changes, and thus misregistration of toner images occurs among the colors.

Japanese Patent Application Laid-Open No. 2012-42754 discloses the following configuration. At the primary transfer portion between the intermediate transfer member and the image bearing member arranged on the uppermost stream, waste toner is supplied as a lubricant. In this manner, fluctuations in circumferential surface speed, which are generated in the intermediate transfer member during an image forming operation, can be reduced, and thus occurrence of color misregistration can be reduced.

However, the waste toner remaining on the intermediate transfer member after a secondary transfer step may contain paper powder generated from the recording material in some cases. The waste toner containing paper powder has low flowability because foreign matters are mixed therein. The waste toner having low flowability is unstable in lubricity. Therefore, when the waste toner is used as a lubricant, it is difficult to reduce the fluctuations in circumferential surface speed, which are generated in the intermediate transfer member during the image forming operation.

SUMMARY OF THE INVENTION

A purpose of the present invention is to reduce fluctuations in circumferential surface speed, which are generated in an intermediate transfer member during an image forming operation, without using waste toner as a lubricant.

Another purpose of the present invention is to provide an image forming apparatus, including a plurality of image bearing members on each of which electrostatic latent images is formed, a plurality of developing devices each of which is provided to correspond to each of the plurality of image bearing members, each of the plurality of developing devices configured to develop an electrostatic latent image formed on each of the plurality of image bearing members to form toner images, an intermediate transfer member which is rotatable and is configured to form primary transfer portions with the plurality of image bearing members, and a control unit that is configured to execute an image forming mode in which the toner images are primarily transferred onto the intermediate transfer member at the primary transfer portions, and the toner images primarily transferred onto the intermediate transfer member are secondarily transferred onto a recording material at a secondary transfer portion, wherein in a case where the control unit executes the image forming mode, after the image forming mode starts until a toner image is primarily transferred onto the intermediate transfer member from an uppermost-stream image bearing member of the plurality of image bearing members provided at an uppermost stream position in a rotation direction of the plurality of image bearing members, the control unit is configured to provide a toner patch onto at least one of the primary transfer portions, wherein the toner patch is formed by developing an electrostatic latent image formed on each of the plurality of the image bearing members by each of the plurality of the developing devices.

A further purpose of the present invention is to provide an image forming apparatus, including a plurality of image bearing members on each of which electrostatic latent images is formed, a plurality of developing devices each of which is provided to correspond to each of the plurality of image bearing members, respectively, each of the plurality of developing devices being configured to develop one of the electrostatic latent images formed on corresponding one of the plurality of image bearing members, an intermediate transfer member which is rotatable and is configured to form a plurality of primary transfer portions with the plurality of image bearing members, and a control unit that is configured to execute an image forming mode in which toner images developed on the plurality of image bearing members at the plurality of the primary transfer portions are primarily transferred onto the intermediate transfer member, and the toner images primarily transferred onto the intermediate transfer member are secondarily transferred onto a recording material at a secondary transfer portion, wherein in a case where the control unit executes the image forming mode, after the image forming mode starts until a toner image is primarily transferred onto the intermediate transfer member from an upper most one of the plurality of the image bearing members provided at an uppermost stream position in a rotation direction of the plurality of image bearing members at an upper most one of the plurality of the primary transfer portions formed between the intermediate transfer member and the uppermost one of the plurality of the image bearing members, the control unit is configured to provide a toner patch by developing the electrostatic latent images formed on the plurality of the image bearing members by the plurality of the developing devices onto at least one of the plurality of the primary transfer portions.

Further features of the present invention will become apparent from the following description of exemplary embodiments with reference to the attached drawings.

DESCRIPTION OF THE EMBODIMENTS

In the following, an image forming apparatus according to the present invention is described in detail with reference to the drawings.

First Embodiment

Figure 1A:
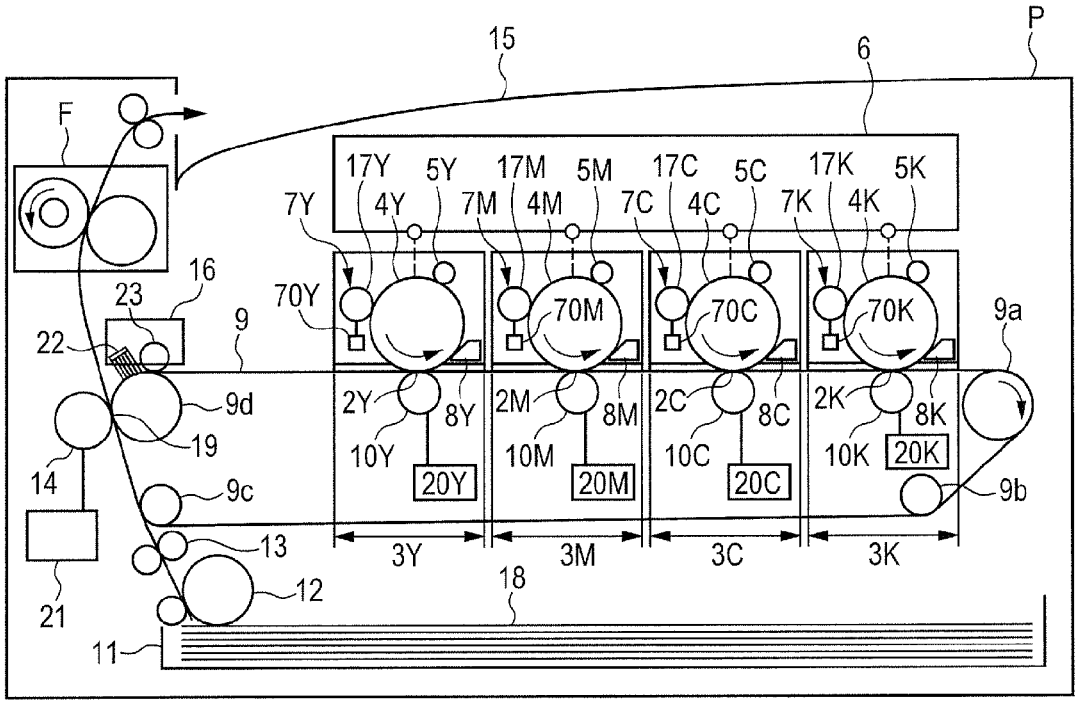
FIG. 1A is a schematic view of an entire image forming apparatus according to a first embodiment of the present invention.
Figure 1B:
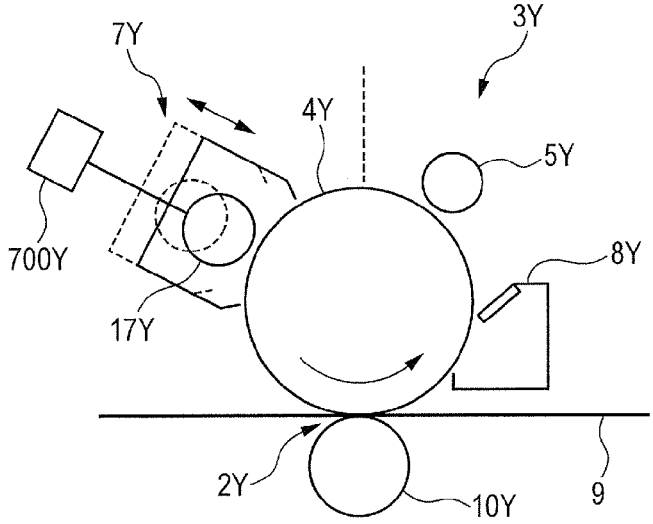
FIG. 1B is a schematic view illustrating a contacting operation of a developing roller at an image forming unit of the image forming apparatus according to the first embodiment of the present invention.

With reference to FIGS. 1A and 1B, an overview of the configuration and operation of an image forming apparatus according to an embodiment of the present invention is described. FIG. 1A is a schematic configuration view illustrating an image forming apparatus P used in a first embodiment of the present invention.

The image forming apparatus P includes the plurality of image forming units 3. In this embodiment, the image forming apparatus P includes four image forming units arrayed in a substantially linear manner, that is, image forming units 3 (3Y, 3M, 3C, and 3K) for forming yellow (Y), magenta (M), cyan (C), and black (K) images, respectively. The image forming units 3Y, 3M, 3C, and 3K include drum-type photosensitive members (hereinafter referred to as "photosensitive drums") 4 (4Y, 4M, 4C, and 4K) each serving as a first image bearing member, and charging rollers 5 (5Y, 5M, 5C, and 5K) each serving as a charging device, respectively. Further, the image forming units 3 (3Y, 3M, 3C, and 3K) include developing devices 7 (7Y, 7M, 7C, and 7K), respectively. Still further, the image forming units 3 (3Y, 3M, 3C, and 3K) include cleaning devices 8 (8Y, 8M, 8C, and 8K) each serving as an image bearing member cleaning device for cleaning toner on the image bearing member, respectively. The developing devices 7 (7Y, 7M, 7C, and 7K) include roller-shaped developing rollers 17 (17Y, 17M, 17C, and 17K) each serving as a developer carrying member, respectively. The developing rollers 17 (17Y, 17M, 17C, and 17K) are connected to developing bias power supplies 70 (70Y, 70M, 70C, and 70K), respectively. Referring to FIG. 1B as well, the developing devices 7 (7Y, 7M, 7C, and 7K) are provided so as to be capable of contacting with or separating from the photosensitive drums 4 (4Y, 4M, 4C, and 4K) by separating units 700 (700Y, 700M, 700C, and 700K), respectively.

Figure 2:
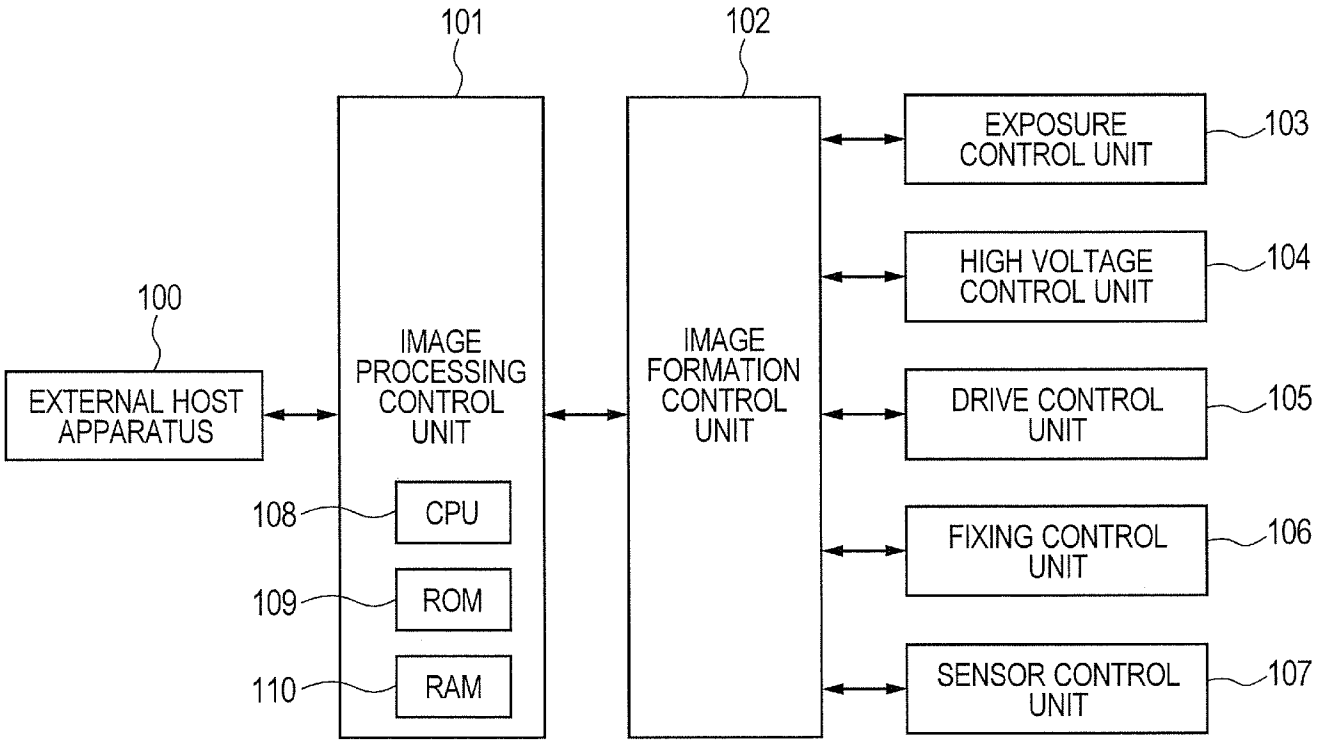
FIG. 2 is a diagram illustrating a control configuration of the image forming apparatus according to the first embodiment of the present invention.

Next, with reference to FIG. 2, the control configuration of the image forming apparatus P is described. The image forming apparatus P receives a print signal from an external host apparatus 100 such as a personal computer connected from the outside. The image forming apparatus P executes an image forming operation onto a recording material 18 based on an image signal of the print signal. An image processing control unit 101 converts data received from the external host apparatus 100 into a YMCK signal. After that, the image processing control unit 101 generates an exposure signal for an exposing unit 6 based on the converted signal.

An image formation control unit 102 controls the entire image forming operation described below. The image formation control unit 102 includes a CPU 108 for executing control processing by the image formation control unit 102, a ROM 109 which stores a program and the like to be executed by the CPU 108, and a RAM 110 which temporarily stores various data at the time of the control processing by the CPU 108. As illustrated in FIG. 2, the image formation control unit 102 is connected to an exposure control unit 103, a high voltage control unit 104, a drive control unit 105, a fixing control unit 106, and a sensor control unit 107 to control operations of those units.

The exposure control unit 103 performs, for example, driving of a laser emitting portion forming the exposing unit 6 or driving of a scanner motor (not shown). The high voltage control unit 104 charges the photosensitive drum 4 during image formation. Further, the high voltage control unit 104 controls, during the image formation, power supplies for applying a developing bias, a primary transfer bias, a secondary transfer bias, and a cleaning bias for an intermediate transfer belt 9. The drive control unit 105 performs driving of the photosensitive drum 4, driving of the developing roller 17, control of the separating unit 700 for contacting or separating of the developing roller 17, driving of a drive roller 9*a* of the intermediate transfer belt 9, and driving of, for example, a conveyance motor (not shown) for conveying the recording material 18. The fixing control unit 106 performs temperature adjustment of a fixing unit F. The sensor control unit 107 performs detection of toner remaining amount and detection of position of the recording material 18 in a conveyance path.

When the image forming apparatus P receives the print signal, the photosensitive drums 4 (4Y, 4M, 4C, and 4K) of the respective image forming units 3 (3Y, 3M, 3C, and 3K) are rotated in the arrow direction. At this time, the developing rollers 17 (17Y, 17M, 17C, and 17K) are in a state of being separating from the photosensitive drums 4 (4Y, 4M, 4C, and 4K), respectively. Then, the outer peripheral surfaces (surfaces) of the photosensitive drums 4 (4Y, 4M, 4C, and 4K) are uniformly charged by the charging rollers 5 (5Y, 5M, 5C, and 5K), respectively. After the surfaces of the photosensitive drums 4 (4Y, 4M, 4C, and 4K) are uniformly charged, the developing devices 7 (7Y, 7M, 7C, and 7K) are brought into contact with the photosensitive drums 4 (4Y, 4M, 4C, and 4K), respectively, under a state in which the developing bias is applied. That is, the developing devices 7 (7Y, 7M, 7C, and 7K) are in a development enabled state. The exposing unit 6 irradiates the charged surfaces of the photosensitive drums 4 (4Y, 4M, 4C, and 4K) with laser light in accordance with image information, to thereby form electrostatic latent images. The electrostatic latent images are visualized by the developing devices 7 (7Y, 7M, 7C, and 7K) with use of toner of respective colors, to thereby form the toner images. On the surface of the photosensitive drum 4Y, the surface of the photosensitive drum 4M, the surface of the photosensitive drum 4C, and the surface of the photosensitive drum 4K, a Y toner image, an M toner image, a C toner image, and a K toner image are formed, respectively.

Note that, in this embodiment, the contacting/separating operation of the developing rollers 17 (17Y, 17M, 17C, and 17K) and the application of the developing bias are simultaneously performed in the four image forming units 3 (3Y, 3M, 3C, and 3K).

In this embodiment, the photosensitive drums 4 (4Y, 4M, 4C, and 4K) are each a negatively chargeable organic photo conductor which includes, on an aluminum cylinder, at least a charge generating layer and a charge transporting layer containing a polyarylate resin. The toner to be used is negative toner.

The endless-belt type intermediate transfer member (hereinafter referred to as "intermediate transfer belt") 9 serving as a second image bearing member, which is provided along the arraying direction of the image forming units 3 (3Y, 3M, 3C, and 3K), is stretched around the drive roller 9*a*, a driven roller 9*b*, an auxiliary roller 9*c*, and a secondary transfer opposing roller 9*d*.

The drive roller 9*a* rotates in the arrow direction as indicated in FIG. 1A. With this, in this embodiment, the intermediate transfer belt 9 is rotated and moved along the respective image forming units 3Y, 3M, 3C, and 3K at a process speed of 100 mm/s. On an inner peripheral surface (rear surface) of the intermediate transfer belt 9, primary transfer rollers 10 (10Y, 10M, 10C, and 10K) each serving as a first transfer unit are arranged so as to be opposed to the photosensitive drums 4 (4Y, 4M, 4C, and 4K) across the intermediate transfer belt 9, respectively. The intermediate transfer belt 9 and the photosensitive drums 4 (4Y, 4M, 4C, and 4K) form primary transfer portions 2 (2Y, 2M, 2C, and 2K) by the primary transfer rollers 10 (10Y, 10M, 10C, and 10K), respectively. In this embodiment, the distance between the primary transfer portions 2Y and 2M, the distance between the primary transfer portions 2M and 2C, and the distance between the primary transfer portions 2C and 2K are each about 75 mm. The width of each of the primary transfer portions 2 (2Y, 2M, 2C, and 2K) in the movement direction of the intermediate transfer belt 9 is about 1 mm. The primary transfer rollers 10 (10Y, 10M, 10C, and 10K) are connected to primary transfer power supplies 20 (20Y, 20M, 20C, and 20K), respectively, and thus a bipolar voltage can be applied independently thereto. During the primary transfer step, a positive (polarity opposite to the toner polarity) voltage is applied to the primary transfer rollers 10 (10Y, 10M, 10C, and 10K) by the primary transfer power supplies 20 (20Y, 20M, 20C, and 20K).

In the primary transfer step, the toner images formed on the photosensitive drums 4 (4Y, 4M, 4C, and 4K) are primarily transferred onto the intermediate transfer belt 9 at the primary transfer portions 2 (2Y, 2M, 2C, and 2K), respectively. With this, the toner images of the respective colors are sequentially superimposed and transferred (primarily transferred), and thus a full-color toner image is formed on the surface of the intermediate transfer belt 9. After the primary transfer of the toner images from the photosensitive drums 4 (4Y, 4M, 4C, and 4K) to the intermediate transfer belt 9 ends, the developing devices 7 (7Y, 7M, 7C, and 7K) move again to come into a state of being separated from the photosensitive drums 4 (4Y, 4M, 4C, and 4K), respectively, and the application of the developing bias and the rotating operation are stopped. That is, the developing devices 7 (7Y, 7M, 7C, and 7K) are in a development disabled state. Transfer residual toner remaining on the surfaces of the photosensitive drums 4 (4Y, 4M, 4C, and 4K) after the primary transfer is removed by cleaning blades (not shown) provided in the cleaning devices 8 (8Y, 8M, 8C, and 8K), respectively. With this, the photosensitive drums 4 (4Y, 4M, 4C, and 4K) are subjected to the next image formation.

On the other hand, the recording materials 18 stacked and received in a feeding cassette 11 provided at a lower portion of the image forming apparatus P are separated and fed one by one from the feeding cassette 11 by a feeding roller 12, and are fed to a registration roller pair 13. The registration roller pair 13 conveys the recording material 18 to a secondary transfer portion 19 formed between the intermediate transfer belt 9 and a secondary transfer roller 14 in synchronization with the toner image formed on the intermediate transfer belt 9. With this, the recording material 18 is subjected to the secondary transfer step. In the secondary transfer step, onto the recording material 18 passing through the secondary transfer portion 19, a full-color toner image is secondarily transferred from the surface of the intermediate transfer belt 9. During the secondary transfer step, a positive (polarity opposite to the toner polarity) voltage is applied to the secondary transfer roller 14 by a secondary transfer power supply 21 capable of applying a bipolar voltage. With this charging, the toner image on the surface of the intermediate transfer belt 9 is secondarily transferred onto the recording material 18. After that, the recording material 18 having the unfixed toner image borne thereon is conveyed to the fixing unit F, and is heated and pressurized in the fixing unit F. Thus, the toner image is fixed onto the recording material 18. After that, the recording material 18 is delivered from the fixing unit F to a delivery tray 15 outside the image forming apparatus P.

The transfer residual toner remaining on the surface of the intermediate transfer belt 9 after the secondary transfer is removed by the action of a cleaning unit 16 serving as an intermediate transfer member cleaning unit. The cleaning unit 16 includes a cleaning brush 22 serving as a brush member and a cleaning roller 23 serving as a roller member. The residual toner on the intermediate transfer belt 9 is leveled by the cleaning brush 22, and is next charged by the cleaning roller 23. The charged toner is reversely transferred onto the photosensitive drums 4 (4Y, 4M, 4C, and 4K) of the image forming units 3, and is removed by the cleaning devices 8. With this, the intermediate transfer belt 9 is subjected to the next image formation.

Note that, as the cleaning unit 16, there may be adopted a structure in which the toner is directly taken off from the intermediate transfer belt 9, for example, a structure in which the toner is scraped by using the cleaning blade. When a charging member (cleaning brush 22 and cleaning roller 23) is adopted as the cleaning unit 16 as in this embodiment, it is advantageous in that, during cleaning, toner is provided on the photosensitive drums 4 (4Y, 4M, 4C, and 4K) and the intermediate transfer belt 9 as much as possible so that the frictional force generated between the intermediate transfer belt 9 and the photosensitive drums 4 (4Y, 4M, 4C, and 4K) is reduced.

In this embodiment, the outer circumference of the intermediate transfer belt 9 is about 700 mm, and the intermediate transfer belt 9 is formed of a polyvinylidene fluoride (PVDF) base layer having a thickness of about 80 μm and a coat layer made of an acrylic resin and having a thickness of about 3 μm. The volume resistivity of the intermediate transfer belt 9 is about $5\times10^{10}$ Ωcm.

In this embodiment, in order to prevent deterioration of toner due to unnecessary rotation of the developing devices 7 (7Y, 7M, 7C, and 7K), the developing devices 7 (7Y, 7M, 7C, and 7K) are separated from the photosensitive drums 4 (4Y, 4M, 4C, and 4K), respectively. In such a case, transfer (fogging) of a trace amount of toner from the developing devices 7 (7Y, 7M, 7C, and 7K) to the photosensitive drums 4 (4Y, 4M, 4C, and 4K), respectively, hardly occurs, and hence the frictional force between the intermediate transfer belt 9 and each of the photosensitive drums 4 (4Y, 4M, 4C, and 4K) tends to increase.

When there is a speed difference between the intermediate transfer belt 9 and each of the photosensitive drums 4 (4Y, 4M, 4C, and 4K), due to the above-mentioned frictional force between the intermediate transfer belt 9 and each of the photosensitive drums 4 (4Y, 4M, 4C, and 4K), the intermediate transfer belt 9 may be driven by each of the photosensitive drums 4 (4Y, 4M, 4C, and 4K), or the photosensitive drums 4 (4Y, 4M, 4C, and 4K) may become loads imposed on the drive of the intermediate transfer belt 9. As a result, the intermediate transfer belt 9 may be slacked and gears forming a drive portion for driving the drive roller 9*a* may be loosened or strained.

When the image forming operation for the print image is performed under this state, misregistration of images may occur among the respective colors in some cases. The reason is as follows. When the toner images which become a print image are provided from the photosensitive drums 4 (4Y, 4M, 4C, and 4K) to the primary transfer portions 2 (2Y, 2M, 2C, and 2K), respectively, forces acting between the surface of the intermediate transfer belt 9 and the surfaces of the photosensitive drums 4 (4Y, 4M, 4C, and 4K) are reduced.

Figure 3A:
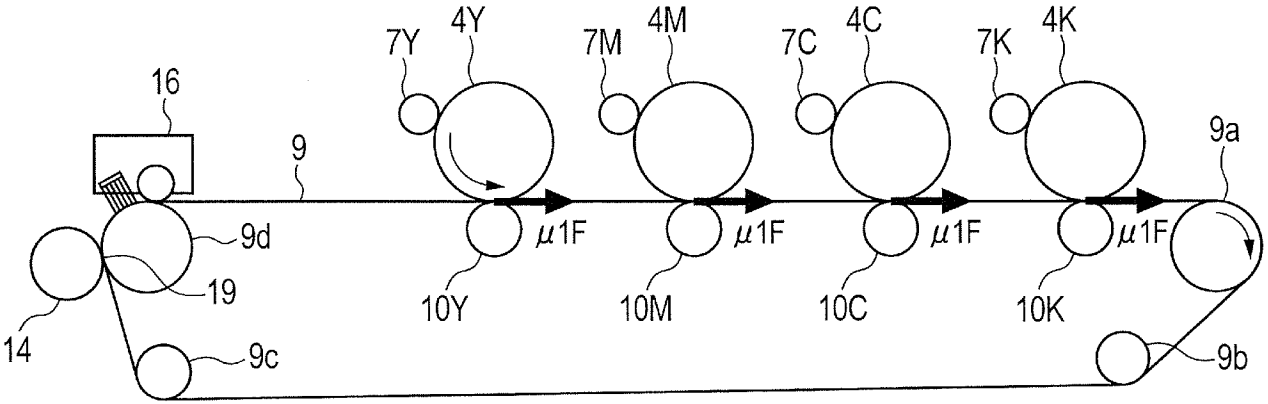
FIGS. 3A and 3B are views illustrating changes of a force acting between an intermediate transfer belt and each of photosensitive drums.
Figure 3B:
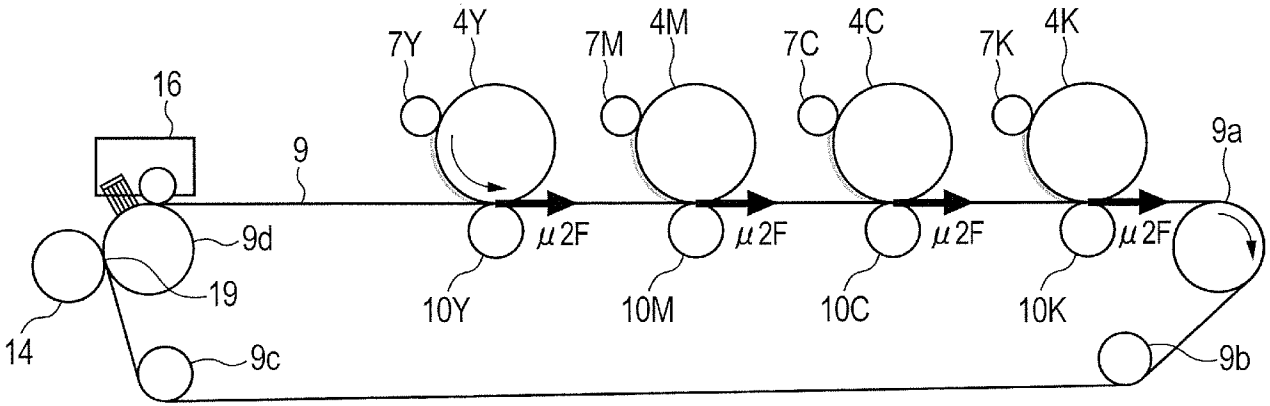

Referring to FIGS. 3A and 3B, a difference in forces acting between the photosensitive drum and the intermediate transfer belt, which change depending on whether or not the developing roller is brought into contact with the photosensitive drum, is described. FIGS. 3A and 3B illustrate an example in which the surface speed of the photosensitive drum is higher than that of the intermediate transfer belt due to fluctuations in outer diameter tolerance.

When the rotational drive of the intermediate transfer belt is started, the surface of the photosensitive drum is charged by the charging roller, and the primary transfer bias is applied, an electrostatic attraction force acts between the photosensitive drum and the intermediate transfer belt. A normal force acting between the photosensitive drum 4 and the intermediate transfer belt 9 is represented by F. At this time, when the developing roller 7 is separated from the photosensitive drum and is in the development disabled state as illustrated in FIG. 3A, the surface of the intermediate transfer belt 9 and the surface of the photosensitive drum 4 are brought into direct contact with each other, resulting in a high frictional force state. The friction coefficient at this time is represented by $\mu 1$. As a result, at each primary transfer nip portion, the intermediate transfer belt 9 receives a force of $\mu 1$ F from the photosensitive drum 4.

On the other hand, when the developing roller 7 is brought into contact with the photosensitive drum 4 and is in the development enabled state as illustrated in FIG. 3B, toner is supplied from the developing roller 7 to the surface of the photosensitive drum 4. As a result, the surface of the photosensitive drum 4 and the surface of the intermediate transfer belt 9 are brought into contact with each other through an intermediation of the toner, and hence as compared to a case where the developing roller 7 is in the development disabled state, the frictional force is lower. The friction coefficient at this time is represented by $\mu 2$ ($\mu 1 > \mu 2$).

As a result, at each primary transfer nip portion, the intermediate transfer belt 9 receives a force of $\mu 2$ F from the photosensitive drum 4.

As described above, when the toner image developed on each photosensitive drum 4 reaches the primary transfer nip portion, the frictional force is reduced. In other words, when the image formation for the print image is performed under a state in which the frictional force is large, each time the toner image is transferred onto the intermediate transfer belt 9, the frictional force is gradually reduced due to the transferred toner image. Along therewith, the surface speed of the intermediate transfer belt 9 and the surface speed of each photosensitive drum 4 (4Y, 4M, 4C, or 4K) fluctuate. Accordingly, the toner images of the respective colors are misaligned at the time of primary transfer.

In the following, the misregistration occurring when the surface speed of the photosensitive drums 4 (4Y, 4M, 4C, and 4K) and the surface speed of the intermediate transfer belt 9 have a difference in magnitude is described in more detail.

(1) When the surface speed of the photosensitive drums 4 (4Y, 4M, 4C, and 4K) is higher than the surface speed of the intermediate transfer belt 9

For example, when the diameters of the photosensitive drums 4 (4Y, 4M, 4C, and 4K) are larger than the center value of the tolerance or when the diameter of the drive roller 9*a* is smaller than the center value of the tolerance, the surface speed of the photosensitive drums 4 (4Y, 4M, 4C, and 4K) is higher than the surface speed of the intermediate transfer belt 9. In such a case, due to the friction, forces of the photosensitive drums 4 (4Y, 4M, 4C, and 4K) to push the intermediate transfer belt 9 on the downstream side in the conveyance direction are applied to the intermediate transfer belt 9. As a result, the intermediate transfer belt 9 may be slacked on the downstream side of each of the primary transfer portions 2 (2Y, 2M, 2C, and 2K), or the drive roller 9*a* may be rotated in association with the intermediate transfer belt 9 pushed by the photosensitive drums 4 (4Y, 4M, 4C, and 4K), which may cause loosening between gears for driving the drive roller 9*a*. Under this state, image formation for the print image is started.

When the image formation is started, toner images are sequentially provided in an order from the primary transfer portion 2Y to the primary transfer portion 2K. As a result, the frictional forces that act between the intermediate transfer belt 9 and the photosensitive drums 4 (4Y, 4M, 4C, and 4K) are reduced, and hence the forces of the four photosensitive drums 4Y, 4M, 4C, and 4K to push the intermediate transfer belt 9 to the downstream are reduced. In other words, the intermediate transfer belt 9 that has received drive forces from the photosensitive drums 4 (4Y, 4M, 4C, and 4K) and has been conveyed at a speed higher than a conveyance speed obtained by the drive roller 9*a* alone until then is gradually released from the drive forces from the photosensitive drums 4 (4Y, 4M, 4C, and 4K) as the toner images are sequentially provided to the primary transfer portions 2 (2Y, 2M, 2C, and 2K). In this manner, the speed reduces down to the conveyance speed obtained by the drive roller 9*a*.

By the way, at the time point when the intermediate transfer belt 9 is released from the drive forces from the photosensitive drums 4 (4Y, 4M, 4C, and 4K), as described above, the intermediate transfer belt 9 may be slacked, or the drive gears for the drive roller 9*a* may be loosened. In this case, until the drive roller 9*a* rotates to eliminate the slack and looseness of those portions, drive forces cannot be applied to the intermediate transfer belt 9 at positions of the primary transfer portions 2 (2Y, 2M, 2C, and 2K). Therefore, during a time period until the slack and looseness are eliminated, at the primary transfer portions 2 (2Y, 2M, 2C, and 2K), the speed of the intermediate transfer belt 9 may become remarkably lower than the conveyance speed obtained by the drive roller 9*a* alone, which may cause misregistration of images among respective colors in some cases.

(2) When the surface speed of the photosensitive drums 4 (4Y, 4M, 4C, and 4K) is lower than the surface speed of the intermediate transfer belt 9

On the other hand, for example, when the diameters of the photosensitive drums 4 (4Y, 4M, 4C, and 4K) are smaller than the center value of the tolerance or when the diameter of the drive roller 9*a* is larger than the center value of the tolerance, the surface speed of the photosensitive drums 4 (4Y, 4M, 4C, and 4K) is lower than the surface speed of the intermediate transfer belt 9. In such a case, due to the friction, forces of the photosensitive drums 4 (4Y, 4M, 4C, and 4K) to pull the intermediate transfer belt 9 on the upstream side in the conveyance direction are applied to the intermediate transfer belt 9. As a result, a larger load torque is applied so that the drive roller 9*a* can rotate and drive the intermediate transfer belt 9, and hence a strain is generated in the gears for driving the drive roller 9*a*. When the image formation for the print image is started under this state, the toner images are sequentially provided to the primary transfer portions 2Y, 2M, 2C, and 2K. As a result, the frictional forces that act between the intermediate transfer belt 9 and the photosensitive drums 4 (4Y, 4M, 4C, and 4K) are reduced, and hence the forces of the four photosensitive drums 4Y, 4M, 4C, and 4K to pull the intermediate transfer belt 9 to the upstream are reduced. In other words, the intermediate transfer belt 9 that has received brake forces from the photosensitive drums 4 (4Y, 4M, 4C, and 4K) and has been conveyed at a speed lower than the conveyance speed obtained by the drive roller 9*a* alone until then is gradually released from the brake forces from the photosensitive drums 4 (4Y, 4M, 4C, and 4K) as the toner images are sequentially provided to the primary transfer portions 2 (2Y, 2M, 2C, and 2K). In this manner, the speed increases up to the conveyance speed obtained by the drive roller 9*a*.

By the way, at the time point when the intermediate transfer belt 9 is released from the brake forces from the photosensitive drums 4 (4Y, 4M, 4C, and 4K), as described above, there is a strain in the gears for driving the drive roller 9*a*. In this case, during a period until the strain of the gears for driving the drive roller 9*a* is relaxed, a larger drive force is applied to the intermediate transfer belt 9. Therefore, during a time period until the strain is relaxed, the speed of the intermediate transfer belt 9 may become remarkably higher than the conveyance speed obtained by the drive roller 9*a* alone, which may cause misregistration of images among respective colors in some cases.

In the image forming apparatus P of this embodiment, the drive roller 9*a* is positioned on the downstream side in the conveyance direction of the intermediate transfer belt 9 with respect to the primary transfer portions 2 (2Y, 2M, 2C, and 2K), and hence the above-mentioned relationship is established. On the other hand, when the drive roller 9*a* is positioned on the upstream side in the conveyance direction of the intermediate transfer belt 9 with respect to the primary transfer portions 2 (2Y, 2M, 2C, and 2K), the above-mentioned relationship is reversed.

In this embodiment, in order to eliminate misregistration of images among the respective colors, in an image forming mode, the frictional force is reduced before the image formation.

Figure 4:
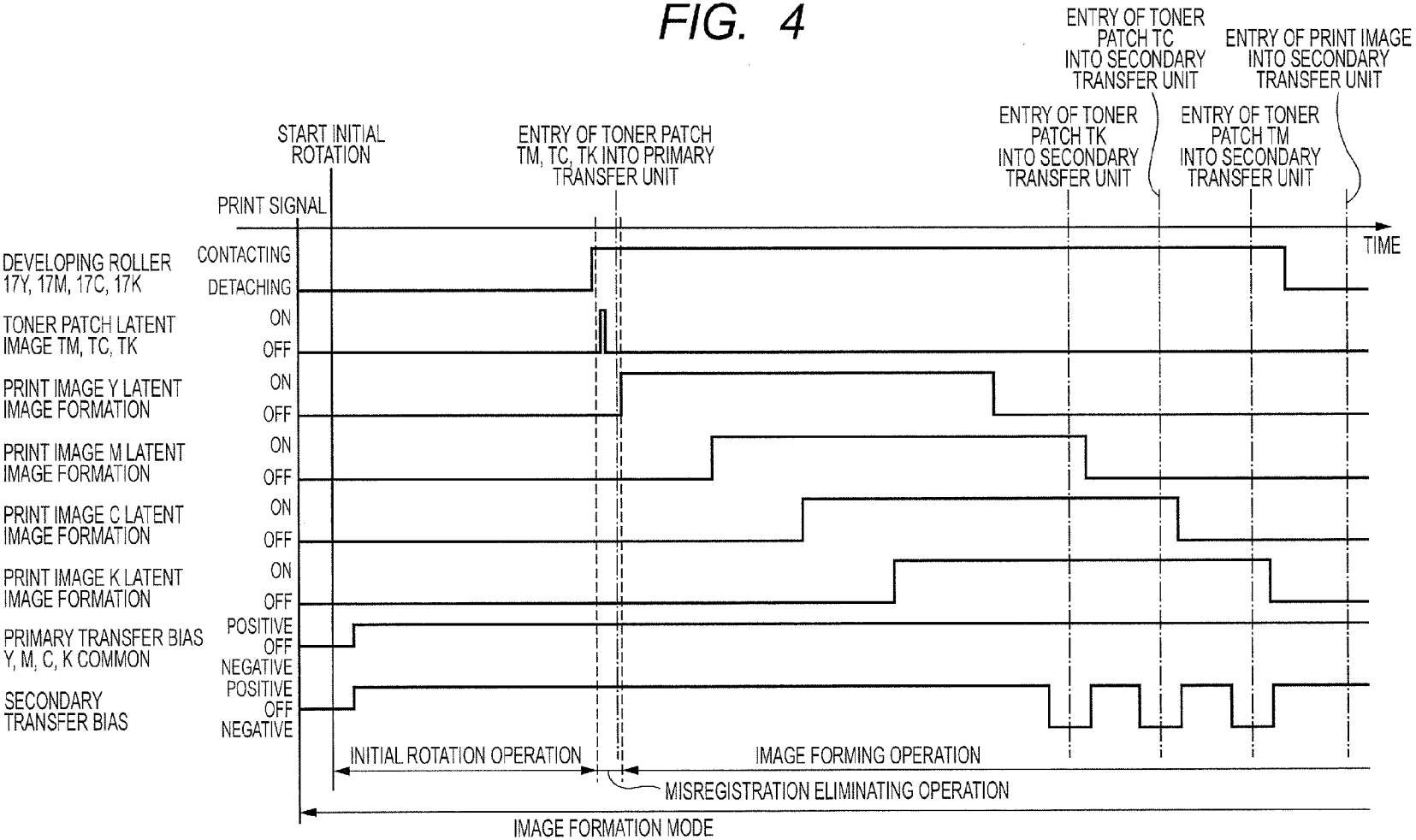
FIG. 4 is a diagram illustrating an image forming mode according to the first embodiment of the present invention.

Next, the image forming mode, which is the feature of this embodiment, is described with reference to FIG. 4.

In response to the reception of the print signal, the image forming apparatus P of this embodiment executes the image forming mode for printing the print image. The image forming mode includes continuous initial rotation operation, image forming operation, and post-rotation operation.

The image forming mode is started when the image processing control unit 101 receives the print signal. After an elapse of a predetermined period after the reception of the print signal, the initial rotation operation is started.

In the initial rotation operation, driving of the photosensitive drums 4 and driving of the drive roller 9*a* are simultaneously started (start of initial rotation). In this embodiment, the four photosensitive drums 4 (4Y, 4M, 4C, and 4K) and the drive roller 9*a* are rotated and driven by a single motor. When the initial rotation operation is started, the developing devices 7 (7Y, 7M, 7C, and 7K) are in a state of being separated from the photosensitive drums 4 (4Y, 4M, 4C, and 4K), respectively. In this embodiment, the diameter of the drive roller 9*a* is 24.5 mm, and in view of manufacture, the drive roller 9*a* has an outer diameter tolerance of about 0.1%. On the other hand, the diameter of each of the photosensitive drums 4 (4Y, 4M, 4C, and 4K) is 24 mm, and the photosensitive drum 4 similarly has an outer diameter tolerance of about 0.1%. When the diameters of the drive roller 9*a* and the photosensitive drums 4 (4Y, 4M, 4C, and 4K) each have a center value of the tolerance, the surface speed of the intermediate transfer belt 9 and the surface speed of the photosensitive drums 4 (4Y, 4M, 4C, and 4K) are set equal to each other. However, for example, in a case of a combination in which the outer diameter of the drive roller 9*a* is the upper limit of the tolerance and the outer diameter of the photosensitive drum 4 is the lower limit of the tolerance, or in a case of a combination in which the outer diameter of the drive roller 9*a* is the lower limit of the tolerance and the outer diameter of the photosensitive drum 4 is the upper limit of the tolerance, there is a risk that the surface speed of the intermediate transfer belt 9 and the surface speed of the photosensitive drum 4 have a speed difference of 0.2% at the maximum.

When the initial rotation operation is started, the rotational drive of the photosensitive drums 4 (4Y, 4M, 4C, and 4K) and the intermediate transfer belt 9 is started, and the surfaces of the photosensitive drums 4 (4Y, 4M, 4C, and 4K) are charged to a uniform potential (Vd potential) by the charging rollers 5 (5Y, 5M, 5C, and 5K), respectively. Next, in order to cause a desired current to flow with respect to the Vd potential of the photosensitive drums 4 (4Y, 4M, 4C, and 4K), the primary transfer power supplies 20 (20Y, 20M, 20C, and 20K) are controlled to apply the primary transfer bias (fixed voltage) to the primary transfer rollers 10 (10Y, 10M, 10C, and 10K), respectively.

When the primary transfer bias is applied, electrostatic attraction forces are applied between the intermediate transfer belt 9 and the photosensitive drums 4 (4Y, 4M, 4C, and 4K) to increase the frictional forces. When the primary transfer power supplies 20 (20Y, 20M, 20C, and 20K) apply the desired primary transfer bias, the developing devices 7 (7Y, 7M, 7C, and 7K) start their contacting operation with respect to the photosensitive drums 4 (4Y, 4M, 4C, and 4K), respectively. In this embodiment, the time period from the start of the initial rotation operation to the contact of the developing devices 7 (7Y, 7M, 7C, and 7K) is about 2.5 seconds. When the contacting operation of the developing devices ends, the initial rotation operation ends.

While the image forming mode is executed, when the initial rotation operation is ended, a misregistration eliminating operation is executed. In this embodiment, as the misregistration eliminating operation, toner patches different from the print image are provided to the primary transfer portions 2M, 2C, and 2K. By providing the toner patches to the primary transfer portions, the friction coefficient between the surface of the photosensitive drum 4 and the surface of the intermediate transfer belt 9 is reduced to reduce the frictional force. The toner patch is formed by developing the electrostatic latent image formed on the photosensitive drum 4 by the developing roller 17, and is formed without using waste toner. Thus, the toner patch does not contain paper powder, and is significantly effective as a lubricant.

In the following, details of the misregistration eliminating operation are described.

In this embodiment, the developing rollers 17 (17Y, 17M, 17C, and 17K) are described as members coming into contact with the photosensitive drums 4 (4Y, 4M, 4C, and 4K) for enabling development of the electrostatic latent images on the photosensitive drums 4 (4Y, 4M, 4C, and 4K), respectively. On the other hand, as another configuration example of the developing devices 7 (7Y, 7M, 7C, and 7K), there are developing devices 7 (7Y, 7M, 7C, and 7K) in which the developing rollers 17 (17Y, 17M, 17C, and 17K) perform development without coming into contact with the respective photosensitive drums 4 (4Y, 4M, 4C, and 4K) in a manner that toner moves onto the photosensitive drums 4 (4Y, 4M, 4C, and 4K) by the electrostatic force. In the developing devices 7 (7Y, 7M, 7C, and 7K) having such a configuration, the developing rollers 17 (17Y, 17M, 17C, and 17K) do not need to come into contact with the respective photosensitive drums 4 (4Y, 4M, 4C, and 4K). However, in order to enable development of the electrostatic latent images on the respective photosensitive drums 4 (4Y, 4M, 4C, and 4K), development bias application and the like are performed. In such developing devices 7 (7Y, 7M, 7C, and 7K), a state in which the development bias and the like are applied and the developing rollers 17 (17Y, 17M, 17C, and 17K) can perform development is referred to as development enabled state.

In this embodiment, after about 250 milliseconds from the contact completion (completion of transition to the development enabled state) of the developing devices 7 (7Y, 7M, 7C, and 7K), the latent image formation for the print image is started onto the photosensitive drum 4Y. During a time period from the contact completion of the developing devices 7 (7Y, 7M, 7C, and 7K) to the start of the latent image formation onto the photosensitive drum 4Y, after about 100 milliseconds from the contact completion of the developing devices 7 (7Y, 7M, 7C, and 7K), the latent image formation for the toner patches T (TM, TC, and TK) is performed onto the photosensitive drums 4M, 4C, and 4K, respectively.

Figure 5:
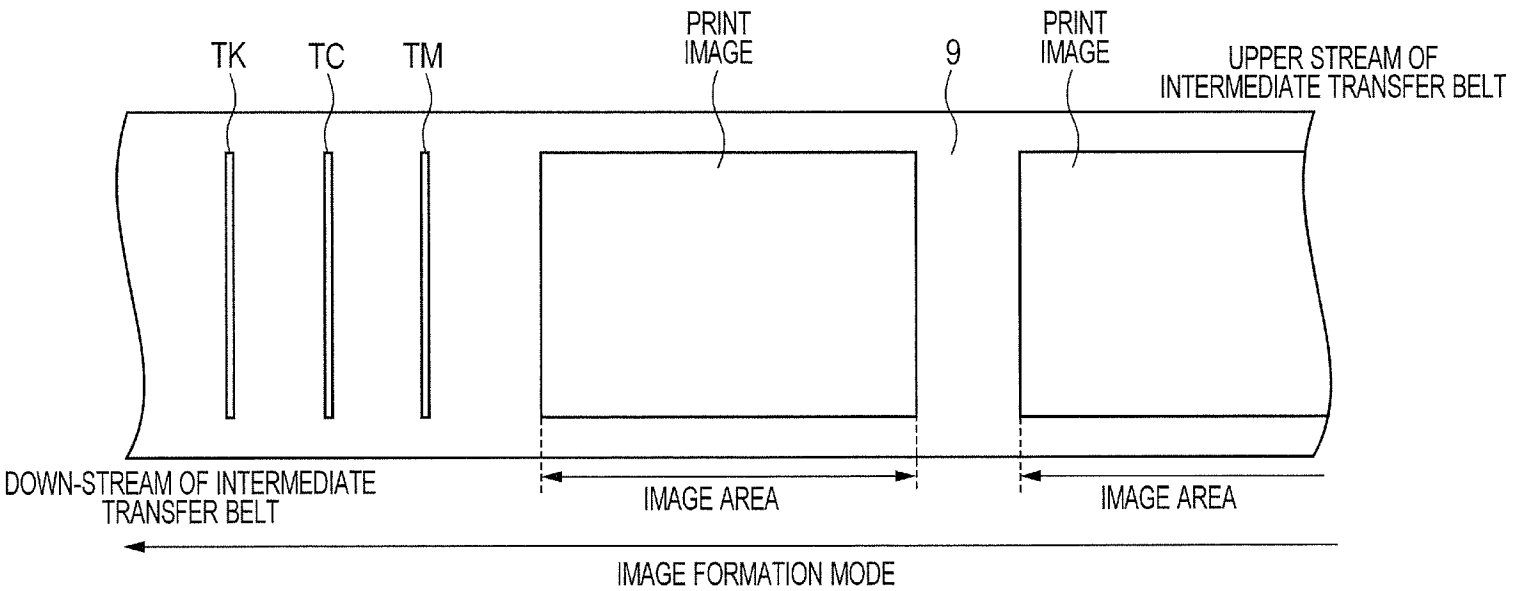
FIG. 5 is a diagram illustrating a positional relationship between each toner patch and an image area during the image forming mode.

As described above, in this embodiment, as illustrated in FIG. 5, the toner patches are provided in a non-image area (area in which the toner images to be transferred onto the recording material are not formed) on the downstream side in the rotation direction of the intermediate transfer belt 9 with respect to an image area on which the toner images to be transferred onto the recording material are transferred. In this embodiment, the latent image formations for the toner patches T (TM, TC, and TK) are simultaneously performed. Therefore, on the intermediate transfer member, the toner patches T (TM, TC, and TK) are formed in the order of the toner patch TK, the toner patch TC, and the toner patch TM from the downstream side in the rotation direction of the intermediate transfer member 9. The print image is formed on the upstream side of the toner patch TM. The distance between the respective toner patches T (TM, TC, and TK) is the distance between the primary transfer portions 2M and 2C, or between the primary transfer portions 2C and 2K. In this embodiment, the distance is about 75 mm.

In this embodiment, the toner patches T (TM, TC, and TK) are each an image in which transverse lines each having a thickness of 0.1 mm and a longitudinal width of 220 mm in a longitudinal direction orthogonal to the rotational movement direction of the intermediate transfer member are repeated five times at intervals of 0.5 mm. In this embodiment, the toner patches T (TM, TC, and TK) are formed as described above, but are not limited thereto. The toner patches T (TM, TC, and TK) may each be an image other than a transverse line image, such as a solid black image or a checkerboard pattern image, which is formed so that the toner amount is substantially uniform at each of the primary transfer portions 2 (2M, 2C, and 2K). In this embodiment, the toner patches T (TM, TC, and TK) are each an image in which the transverse lines are repeated five times, but may be an image of at least one transverse line. Note that, the reason why a toner patch TY is not formed onto the photosensitive drum 4Y on the uppermost stream in the rotational movement direction of the intermediate transfer belt 9 in this embodiment is described later.

The toner patches T (TM, TC, and TK) as described above are developed by the developing devices 7M, 7C, and 7K as toner images, and formed on the photosensitive drums 4M, 4C, and 4K, respectively. The formed toner patches T (TM, TC, and TK) enter substantially simultaneously the primary transfer portions 2M, 2C, and 2K formed between the intermediate transfer belt 9 and the photosensitive drums 4M, 4C, and 4K, respectively, along with rotational drive of the photosensitive drums 4M, 4C, and 4K. The toner patches T (TM, TC, and TK) entering the primary transfer portions 2M, 2C, and 2K receive the actions of the primary transfer rollers 10M, 10C, and 10K applied with the primary transfer bias (voltage having a polarity opposite to the toner polarity; in this case, positive), and the toner patches T (TM, TC, and TK) are transferred onto the intermediate transfer belt 9. At a stage in which the misregistration eliminating operation is ended, formation of the electrostatic latent images with respect to the respective photosensitive drums 4 (4Y, 4M, 4C, and 4K) is started (start of image forming operation).

The electrostatic latent images formed on the respective photosensitive drums 4Y, 4M, 4C, and 4K are developed as toner images by the corresponding developing devices 7 (7Y, 7M, 7C, and 7K). The toner images developed on the photosensitive drums 4Y, 4M, 4C, and 4K are sequentially primarily transferred onto the intermediate transfer belt 9.

In the misregistration eliminating operation, due to the toner patches T (TM, TC, and TK) entering the primary transfer portions 2 earlier than the print image, toner is supplied on the intermediate transfer belt 9, and thus the frictional forces between the intermediate transfer belt 9 and the photosensitive drums 4 (4Y, 4M, 4C, and 4K) are reduced. With this, even when the intermediate transfer belt 9 is slacked or the drive gears for the drive roller 9*a* are loosened or strained during the initial rotation operation, those problems can be eliminated before the image formation for the print image without using the waste toner, and the speed of the intermediate transfer belt 9 during the image formation for the print image can be stabilized.

Along with the rotation of the intermediate transfer belt 9, the toner patch TK, the toner patch TC, the toner patch TM, and the print image sequentially enter the secondary transfer portion 19. The toner patches are formed in the non-image area of the intermediate transfer belt, and hence the timing at which the trailing edge of the toner patch TM reaches the secondary transfer portion becomes earlier than the timing at which the recording material reaches the secondary transfer portion. In this case, in synchronization with the timing at which the toner patches T (TM, TC, and TK) of the respective colors enter the secondary transfer portion 19, the secondary transfer power supply 21 applies a voltage having the same polarity as the toner (in this case, negative) to the secondary transfer roller 14, and applies a positive voltage again after the toner patches T (TM, TC, and TK) have passed through the secondary transfer portion 19. With this, the toner forming the toner patches T (TM, TC, and TK) is prevented from adhering to the secondary transfer roller 14, to thereby reduce the stain on the rear surface of the recording material 18. After the passage of the toner patch TM, a positive voltage is applied to the secondary transfer roller 14 again, and the secondary transfer step for the subsequent print image is performed.

In this embodiment, as described above, the toner patch TY is not formed onto the photosensitive drum 4Y. Considering the effect of suppressing the misregistration, it is desired that the toner patches T (TY, TM, TC, and TK) be formed on all of the photosensitive drums 4 (4Y, 4M, 4C, and 4K), respectively. However, in the image forming apparatus P of this embodiment, if the toner patch TY is formed, the distance between the trailing edge of the toner patch TY and the leading edge of the print image on the intermediate transfer belt 9 after the end of the primary transfer becomes about 12.5 mm, which corresponds to about 125 milliseconds at a process speed of 100 mm/s. In the secondary transfer power supply 21 adopted in the image forming apparatus P of this embodiment, 150 ms is required to switch the output voltage from negative to positive, and hence the secondary transfer bias application for the print image becomes too late if the toner patch TY is formed. For the above-mentioned reason, in this embodiment, the toner patch TY is not formed on the photosensitive drum 4Y. Depending on the distance between the trailing edge of the toner patch TY and the leading edge of the print image, the process speed, and the configuration of the secondary transfer power supply, the secondary transfer bias application can be made in time. In such a case, the toner patch TY may be formed onto the photosensitive drum 4Y.

After the end of the secondary transfer of the print image onto the recording material 18, the post-rotation operation is executed for collecting and cleaning the secondary transfer residual toner remaining on the intermediate transfer belt 9 by the cleaning unit 16 for the intermediate transfer belt 9. Thus, the image forming mode is ended. When the image forming mode is executed in a case where the image formation is performed with respect to the plurality of recording materials successively, the misregistration eliminating operation may be executed at a timing before the image forming operation for the first sheet is executed.

Next, results of effect confirmation of this embodiment and the method thereof are described.

First, with use of the image forming apparatus P of this embodiment, the effects were confirmed with respect to misregistration in the image forming mode for plain paper printing at a process speed of 100 mm/sec (throughput: 18 sheets for 1 minute) in an environment of a temperature of 23° C. and a humidity of 50%.

The employed drive roller 9*a* had an average value of diameters, which were measured at five longitudinal positions of the drive roller 9*a*, smaller by 25 μm than the center value of the tolerance. Further, the employed photosensitive drums 4 (4Y, 4M, 4C, and 4K) in the respective image forming units 3 (3Y, 3M, 3C, and 3K) each had an average value of diameters, which were measured at five longitudinal positions of each of the photosensitive drums 4 (4Y, 4M, 4C, and 4K), larger by about 20 μm than the center value of the tolerance. The employed recording material 18 was a sheet of an A4 size and having a basis weight of 80 g/m$^2$ (trademark: EXTRA), and images having thin transverse lines of respective colors of cyan (C), magenta (M), yellow (Y), and black (K), each having a longitudinal width of 10 mm, were printed so as to be repeatedly arrayed in the longitudinal direction. The misregistration amount was set as the maximum value of the misregistration amounts of the respective colors in the conveyance direction with respect to the black (K) thin transverse line. The misregistration on the sheet trailing edge side was set as a positive direction, and the misregistration on the leading edge side was set as a negative direction.

Next, a comparative example necessary for comparison to the effects of this embodiment is described.

In this comparative example, the misregistration eliminating operation was not executed. Other configurations are similar to those of the first embodiment, and hence description thereof is omitted.

The results of the confirmation of the effects with respect to the misregistration images in the first embodiment and the comparative example are described.

TABLE 1

Comparison of misregistration amount in first embodiment and comparative example (μm)

| | First embodiment | Comparative example |
|---|---|---|
| First round | 115 | 1,397 |
| Second round | 109 | 1,277 |
| Third round | 146 | 861 |
| Fourth round | 121 | 1,105 |
| Average | 123 | 1,160 |

As shown in Table 1, in the comparative example, an unacceptable level of misregistration occurred.

The reason is as follows. In the image forming apparatus P used in the comparative example, the surface speed of the photosensitive drums 4 (4Y, 4M, 4C, and 4K) was higher than the surface speed of the intermediate transfer belt 9 conveyed by the drive roller 9*a*. Therefore, on the downstream of the primary transfer portions 2 (2Y, 2M, 2C, and 2K), the slack of the intermediate transfer belt 9 and the looseness between the drive gears for the drive roller 9*a* occurred. Therefore, when the toner image of the print image entered the primary transfer portions 2 (2Y, 2M, 2C, and 2K), fluctuations in conveyance speed of the intermediate transfer belt 9 occurred. On the other hand, in the configuration of the first embodiment, while executing the image forming mode, before the toner image of the print image entered the primary transfer portions 2 (2Y, 2M, 2C, and 2K), the toner patches T (TM, TC, and TK) formed by the misregistration eliminating operation entered. At this time point, the slack of the intermediate transfer belt 9 and the looseness of the drive gears of the drive roller 9*a* were eliminated. With this, during the primary transfer step for the print image, fluctuations in speed of the intermediate transfer belt 9 did not occur, and thus the misregistration was suppressed.

Second Embodiment

Next, a second embodiment of the present invention is described. A configuration of an image forming apparatus P used in the second embodiment is similar to that of the first embodiment, and hence description thereof is omitted.

Figure 6:
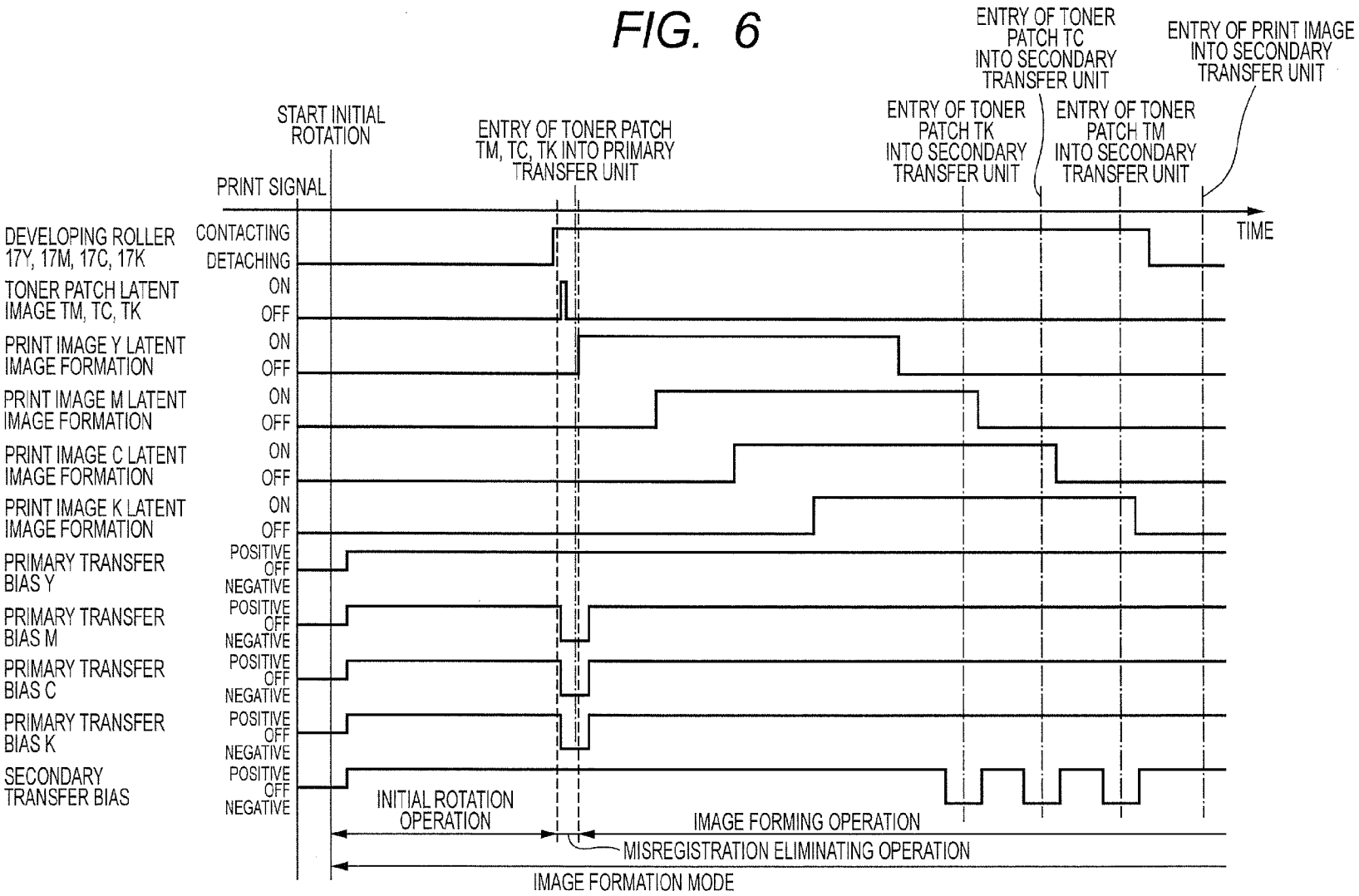
FIG. 6 is a diagram illustrating an image forming mode according to a second embodiment of the present invention.

In the second embodiment, a polarity of the voltage to be applied to the primary transfer rollers 10M, 10C, and 10K during the misregistration eliminating operation is different from that of the first embodiment. An image forming mode, which is the feature of the second embodiment, is described with reference to FIG. 6.

In this embodiment, in the misregistration eliminating operation, when the toner patches TM, TC, and TK enter the respective primary transfer portions 2M, 2C, and 2K, a negative voltage is applied to the primary transfer rollers 10M, 10C, and 10K by the primary transfer power supplies 20M, 20C, and 20K, respectively. The applied voltage is −300 V. After the passage of the toner patches TM, TC, and TK formed in the respective image forming units 3M, 3C, and 3K through the primary transfer portions 2M, 2C, and 2K, a positive primary transfer bias is applied again, to thereby prepare for the primary transfer for the print image. Also in this embodiment, for the same reason as the first embodiment, the toner patches T are formed only onto the photosensitive drums 4M, 4C, and 4K in the misregistration eliminating operation. Other operations are similar to those in the first embodiment.

When the toner patches formed in the misregistration eliminating operation pass through the respective primary transfer portions 2M, 2C, and 2K, a negative voltage is applied to the primary transfer rollers 10M, 10C, and 10K. With this, most of the toner forming the toner patches TM, TC, and TK is not transferred onto the intermediate transfer belt 9 but remains on the photosensitive drums 4M, 4C, and 4K. The toner remaining on the photosensitive drums 4M, 4C, and 4K is cleaned by the cleaning devices 8M, 8C, and 8K, respectively.

In this embodiment, due to the negative voltage applied to the primary transfer rollers 10M, 10C, and 10K, the toner patches TM, TC, and TK are hardly transferred onto the intermediate transfer belt 9, and hence the toner adhesion to the secondary transfer roller 14 can be reduced. In other words, the toner amount of the toner patches T (TM, TC, and TK) on the intermediate transfer belt 9 can be reduced. Therefore, the toner of the toner patches T (TM, TC, and TK) is prevented from transferring onto the surface of the intermediate transfer belt 9 and the surface of the secondary transfer roller 14. Thus, it is possible to prevent toner stain on the rear surface of the recording material 18.

OTHER EMBODIMENTS

As the embodiments of the present invention, the image forming apparatus employing an in-line type intermediate transfer system is described, in which the drive roller for the intermediate transfer member is positioned on the downstream in the movement direction of the intermediate transfer member with respect to the primary transfer portions. Further, the effects of suppressing the misregistration of the present invention are described regarding a case where the conveyance speed of the intermediate transfer member by the drive roller is lower than the rotational drive speed of the surface of the photosensitive drum. The present invention is not limited thereto, and the present invention is effective also in the case where the conveyance speed of the intermediate transfer member is higher than the rotational drive speed of the surface of the photosensitive drum. Further, similar effects can be achieved also in a case where the drive roller for the intermediate transfer member is positioned on the upstream in the movement direction of the intermediate transfer member with respect to the primary transfer portions.

The transverse line image has been used as the toner patch, but it is apparent that similar effects can be expected even with a solid black image, a shaded image, and the like. Further, the toner patch to be provided to the primary transfer portion is formed in each image forming unit. However, the toner patch formed in the image forming unit arranged on the upstream in the movement direction of the intermediate transfer member may be provided to the primary transfer portion arranged on the further downstream.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-091970, filed Apr. 13, 2012, which is hereby incorporated by reference herein in its entirety.

What is claimed is:

1. An image forming apparatus, comprising:

a first image bearing member on which an electrostatic latent image is formed;

a first developing device for developing an electrostatic latent image formed on the first image bearing member;

a second image bearing member on which an electrostatic latent image is formed;

a second developing device for developing an electrostatic latent image formed on the second image bearing member;

an intermediate transfer member which is rotatable and is configured to form a first primary transfer portion with the first image bearing member and a second primary transfer portion with the second image bearing member; and a control unit that is configured to execute an image forming mode, wherein in a case where the control unit receives a print signal for transferring a toner image onto a recording material, the control unit controls a timing of forming a toner patch so that the toner patch developed by the second developing device is provided to the second primary transfer portion between a timing when the control unit receives the print signal and a timing when the toner image developed on the first image bearing member is primarily transferred to the intermediate transfer member at the first primary transfer portion.

2. An image forming apparatus according to claim 1, wherein the second image bearing member is provided on a downstream side of the first image bearing member in a rotation direction of the intermediate transfer member.

3. An image forming apparatus according to claim 1, further comprising a secondary transfer member which contacts an outer peripheral surface of the intermediate transfer belt to form the secondary transfer portion with the intermediate transfer belt, wherein the secondary transfer member secondarily transfers a toner image that reaches the secondary transfer portion to the recording material without secondarily transferring a toner patch that reaches the secondary transfer portion to the recording material.

4. An image forming apparatus according to claim 1, wherein the toner patch is formed by a reception of the print signal by the control unit and is not transferred to the recording material.

5. An image forming apparatus according to claim 1, wherein the intermediate transfer member and the first and second image bearing members start to rotate simultaneously by a reception of the print signal by the control unit.

6. An image forming apparatus according to claim 1, wherein the toner patch includes a transverse line toner patch in which at least one transverse line is formed in a direction orthogonal to the rotation direction of the intermediate transfer member.

7. An image forming apparatus according to claim 6, wherein the transverse line toner patch is larger than a width of each of the primary transfer portions in the rotation direction of the intermediate transfer member.

8. An image forming apparatus according to claim 1, further comprising an intermediate transfer member cleaning unit for charging residual toner remaining on the intermediate transfer member, wherein the residual toner is charged by the intermediate transfer member cleaning unit, and then is moved on each of the plurality of the image bearing members.

9. An image forming apparatus according to claim 2, further comprising:

a third image bearing member on which an electrostatic latent image is formed;

a third developing device for developing an electrostatic latent image formed on the third image bearing member;

a fourth image bearing member on which an electrostatic latent image is formed; and a fourth developing device for developing an electrostatic latent image formed on the fourth image bearing member, wherein the intermediate transfer member is configured to form a third primary transfer portion with the third image bearing member and a fourth primary transfer portion with the fourth image bearing member.

10. An image forming apparatus according to claim 9, wherein the third and fourth image bearing members are provided on a downstream side of the second image bearing member in the rotation direction of the intermediate transfer member.

11. An image forming apparatus according to claim 9, wherein in a case where the control unit receives a print signal for transferring a toner image onto a recording material, the control unit controls a timing of forming a toner patch so that the toner patch developed by the third developing device is provided to the third primary transfer portion and a toner patch developed by the fourth developing device is provided to the fourth primary transfer portion between a timing when the control unit receives the print signal and a timing when the toner image developed on the first image bearing member is primarily transferred to the intermediate transfer member at the first primary transfer portion.

12. An image forming apparatus according to claim 3, wherein a timing at which a trailing edge of the toner patch reaches the secondary transfer portion is earlier than a timing at which the recording material reaches the secondary transfer portion.

13. An image forming apparatus according to claim 12, wherein when the toner patch passes through the secondary transfer portion, a voltage having the same polarity as toner of the toner patch is applied to the secondary transfer member.

* * * * *